US010029831B2

(12) United States Patent
Lee

(10) Patent No.: US 10,029,831 B2
(45) Date of Patent: Jul. 24, 2018

(54) MULTI-FUNCTION WATER BOTTLE HAVING MULTI-FUNCTION CAP

(71) Applicant: Seo Jun Lee, Gyeonggi-do (KR)

(72) Inventor: Seo Jun Lee, Gyeonggi-do (KR)

( * ) Notice: Subject to any disclaimer, the term of this patent is extended or adjusted under 35 U.S.C. 154(b) by 0 days.

(21) Appl. No.: 15/570,252

(22) PCT Filed: May 19, 2016

(86) PCT No.: PCT/KR2016/005300
§ 371 (c)(1),
(2) Date: Oct. 27, 2017

(87) PCT Pub. No.: WO2016/186460
PCT Pub. Date: Nov. 24, 2016

(65) Prior Publication Data

US 2018/0127169 A1 May 10, 2018

(30) Foreign Application Priority Data

May 19, 2015 (KR) ..... 10-2015-0069736

(51) Int. Cl.
*B67D 7/06* (2010.01)
*B65D 47/24* (2006.01)
(Continued)

(52) U.S. Cl.
CPC ..... *B65D 47/243* (2013.01); *B65D 47/122* (2013.01); *B65D 51/24* (2013.01); *B65D 85/72* (2013.01)

(58) Field of Classification Search
CPC .... B65D 47/243; B65D 47/122; B65D 51/24; B65D 85/72
(Continued)

(56) References Cited

U.S. PATENT DOCUMENTS

2004/0124212 A1* 7/2004 Masuda ..... B05B 11/0013 222/183
2010/0102086 A1* 4/2010 Rabinovitch ..... B65D 55/10 222/105
2015/0014354 A1* 1/2015 Kellenberger ..... B65D 81/3876 222/83

FOREIGN PATENT DOCUMENTS

JP 2000-296888 10/2000
JP 2014-037250 2/2014
(Continued)

OTHER PUBLICATIONS

International Search Report dated Sep. 27, 2026 for PCT/KR2016/005300.

(Continued)

*Primary Examiner* — Jeremy W Carroll

(57) ABSTRACT

The present invention relates to a multipurpose water bottle, which comprises: a water bottle main body having a reception space for receiving a liquid therein; and a cap coupled to an upper part of the water bottle main body to discharge the liquid to the outside, wherein the cap comprises: a main body coupling tube coupled to a cap coupling tube disposed at the upper part of the water bottle main body; a liquid discharge tube disposed at an upper part of the main body coupling tube to discharge the liquid to the outside; and an inner coupling tube disposed inside the main body coupling tube and coupled to a first discharge port of a first kind of water bottle, which is received in the reception space of the water bottle main body, to guide, to the liquid discharge tube, a first auxiliary liquid which has been received in the first kind of water bottle.

3 Claims, 5 Drawing Sheets

(51) Int. Cl.
*B65D 85/72* (2006.01)
*B65D 51/24* (2006.01)
*B65D 47/12* (2006.01)

(58) Field of Classification Search
USPC ..... 222/183
See application file for complete search history.

(56) References Cited

FOREIGN PATENT DOCUMENTS

| | | |
|---|---|---|
| KR | 20-0399196 | 10/2005 |
| KR | 10-0928189 | 11/2009 |
| KR | 10-1067748 | 9/2011 |
| KR | 10-2014-0121745 | 10/2014 |

OTHER PUBLICATIONS

Korean Office Action dated Aug. 15, 2015 corresponding to Korean Patent Application No. 10-2015-0069736.

* cited by examiner

< Prior Art >

MULTI-FUNCTION WATER BOTTLE HAVING MULTI-FUNCTION CAP

This application claims the priority of Korean Patent Application No. 10-2015-00697369, filed on May 19, 2015 in the KIPO (Korean Intellectual Property Office), the disclosure of which is incorporated herein entirely by reference. Further, this application is the National Stage application of International Application No. PCT/KR2016/005300, filed May 19, 2016, which designates the United States and was published in Korean. Each of these applications is hereby incorporated by reference in their entirety into the present application.

TECHNICAL FIELD

The present disclosure relates to a multi-function water bottle, and more particularly, to a multi-function water bottle accommodating therein various kinds of containers in various sizes for use thereof.

BACKGROUND ART

People's interest in leisure has increased, and more and more people are enjoying outdoor activities such as exercising, traveling, hiking, fishing, golf, cycling, in-line skating, and so on. People who work in the outdoors or those who work in construction sites, farmland, etc. having limited access to water generally buy and drink bottled water or sports drinks when they feel thirsty, or carry water in their personal bottles.

An example of a conventional portable water bottle is disclosed in Korean Registered Utility Model No. 20-0399196, titled "Portable water bottle".

FIG. 1 is an exemplary view showing a conventional sports water container 10, a first kind of water container 20, and a second kind of water container 30. As shown, the conventional sports water container 10 includes a water container body 11 in which water is contained, and a water bottle cap 13 that is used in the state of being coupled to the water container body 11.

However, after the sports water container 10 is used for a certain period, the inside of water bottle cap 13 is filled with slime and has to be frequently cleaned before use, which is inconvenient and also unsanitary.

Meanwhile, for activity such as cycling, the sports water container 10 of a specific size is used so that it can be mounted on the cycle. When the user drinks up all the water contained in the specific-size sports water container 10 and needs more water or drink, he/she purchases bottled water or sports drinks. However, in this case, there is a problem that the first kind of water container 20 containing water and the second kind of water container 30 containing sports beverage are different in size from the sports water container 10 and therefore cannot be mounted on the cycle. The user may pour the water of the first kind of water container 20 or sports beverage of the second kind of water container 30 he/she purchased into the sports water container 10 and drink the water or sports beverage from the sports water container 10.

However, because the user pours new water or sports beverage in the sports water container 10 from which he/she drank up the water or beverage previously contained therein, this will result in mixed taste, and also unsanitary problem.

DISCLOSURE OF THE INVENTION

Technical Problem

An object of the present disclosure is to solve the problems mentioned above, and accordingly, it is an object of the present disclosure to provide a multi-function water bottle capable of accommodating different kinds of water bottles therein for purpose of drinking beverages.

Another object of the present disclosure is to provide a multi-function water bottle with which different kinds of water bottles can be used while being coupled to a single cap.

The above objects and various advantages of the present disclosure will become more apparent from the preferred embodiments of the present disclosure by those skilled in the art.

Technical Solution

The object of the disclosure can be achieved by a multi-function water bottle. A multi-function water bottle according to an exemplary embodiment may include a water bottle main body having a reception space in which a liquid is contained, a cap coupled to an upper part of the water bottle main body to discharge the liquid to the outside, wherein the cap comprises: a main body coupling tube coupled to a cap coupling tube disposed at the upper part of the water bottle main body; a liquid discharge tube provided at an upper part of the main body coupling tube to discharge the liquid to the outside; and an inner coupling tube disposed inside the main body coupling tube and coupled to a first discharge port of a first kind of water bottle received in the reception space of the water bottle main body, to guide, to the liquid discharge tube, a first auxiliary liquid which has been received in the first kind of water bottle.

According to an embodiment, multi-function water bottle may further include an intermediate coupling tube provided between the inner coupling tube and the main body coupling tube and coupled to a second outlet of a second kind of water bottle to guide a second auxiliary liquid received in the second kind of water container to the liquid discharge tube.

According to one embodiment, the first kind of water container may be any of a bottled water container, a carbonated drink bottle, and a fruit juice bottle having a first diameter, and the second kind of water container may be any of a bottled water container, a sports drink bottle and a fruit juice drink bottle, having a second outlet with a diameter greater than that of the first outlet of the first kind of water container.

According to one embodiment, the inner coupling tube may include a third screw thread formed along an inner wall surface and screw-coupled to the first outlet of the first kind of water container, a main body coupling surface formed horizontally by a predetermined area on an upper surface and fixedly coupled to a lower surface of the cap coupling tube; and an upper outlet extending through the main body coupling surface to guide the first auxiliary liquid to the liquid discharge tube, and the intermediate coupling tube may include a coupling tube coupling surface, on which a lower end of the inner coupling tube is fixed, and through which a lower outlet formed communicatively with the upper outlet is extended, and a fifth screw thread formed along an inner wall surface and screw-coupled to the second outlet of the second kind of water container.

Advantageous Effects

The present disclosure gives the following effects. The multi-function water bottle according to exemplary embodiments not only allows the user to drink the liquid contained in the water bottle main body, but also accommodates therein the first kind of water container or the second kind of water container containing different kinds of liquid and drinks the same.

Accordingly, one cap can be coupled to both the first kind of water container and the second kind of water container and thus, user convenience is provided. In addition, since the first kind of water container and the second kind of water container can be received and stored within the water bottle main body, mixing of the remaining liquid in the water bottle main body with the auxiliary liquid of the first kind of water container or the second kind of water container is prevented, and accordingly, hygienic storage can be provided.

Further, when performing a sporting activity such as cycling, the user may store the first kind of water container and the second kind of water container of different sizes within the multi-function water bottle that is customized for the holder, such that the user can focus on sporting activity stably while he or she enjoys various kinds of drinks.

MODE FOR CARRYING OUT THE INVENTION

Figure 1:
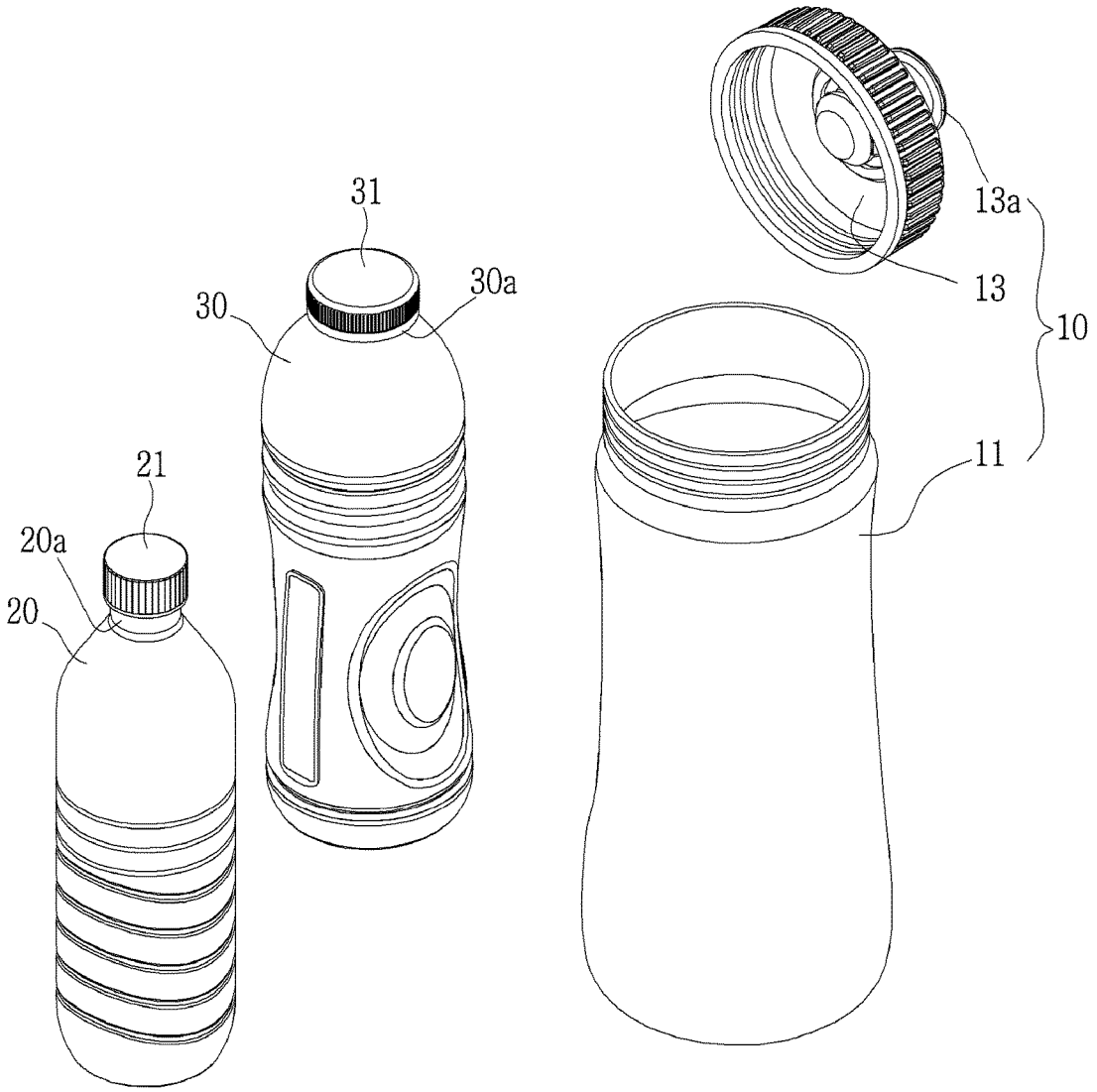
FIG. 1 is an exemplary view showing a configuration of a conventional sport water bottle, a bottled water container, and a sports beverage bottle.

In order to fully understand the present disclosure, certain embodiments of the present disclosure will be described with reference to the accompanying drawings. However, the embodiments according to the present disclosure can be modified in various forms, and the scope of the present disclosure is not to be construed as being limited to the embodiments described below. The embodiments of the present disclosure are provided to enable those skilled in the art to more fully understand the present disclosure. Therefore, the shapes of elements or the like in the drawings may be exaggeratedly expressed to emphasize a clearer description. It should be noted that in the drawings, the same members may be denoted by the same reference numerals. Detailed descriptions of well-known functions and configurations that may unnecessarily obscure the gist of the present disclosure are omitted.

Figure 2:
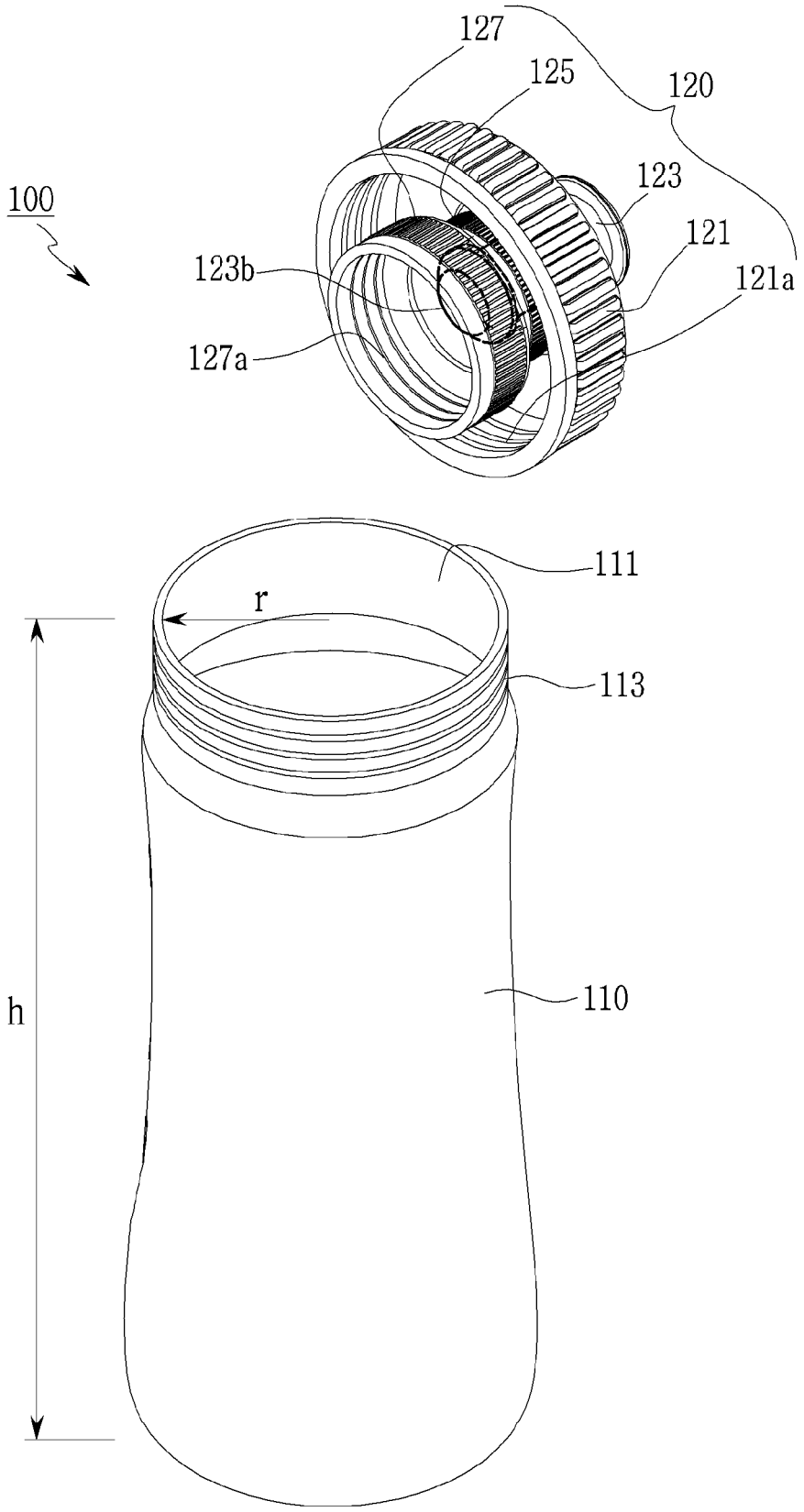
FIG. 2 is a perspective view showing a configuration of a multi-function water bottle according to an exemplary embodiment.
Figure 3:
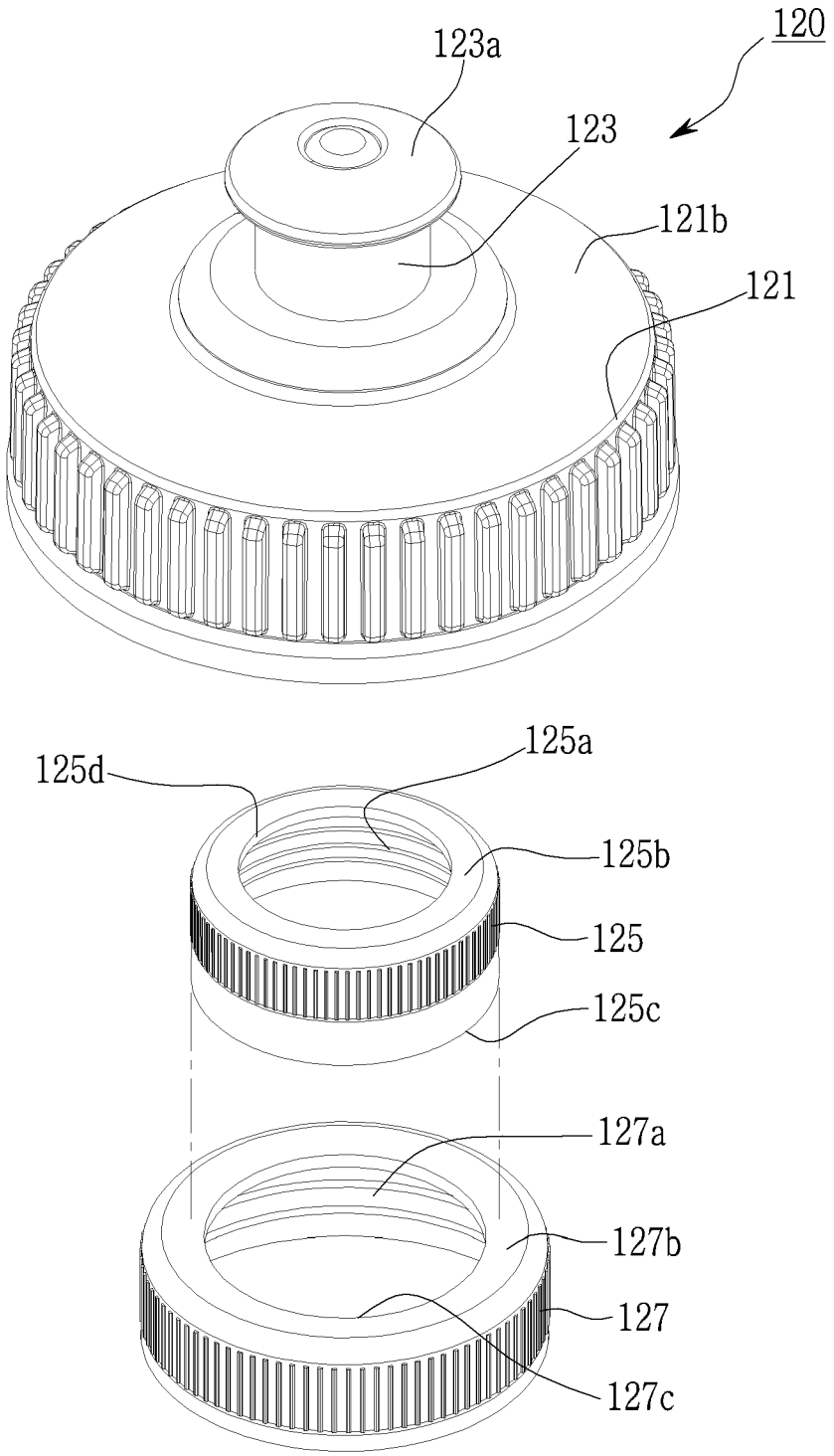
FIG. 3 is an exploded perspective view of a cap of a multi-function water bottle according to an exemplary embodiment.

FIG. 2 is a perspective view showing a configuration of a multi-function water bottle 100 according to an exemplary embodiment, and FIG. 3 is an exploded perspective view showing the configuration of a cap 120 of the multi-function water bottle 100 according to an embodiment of the present disclosure.

As shown, the multi-function water bottle 100 according to an exemplary embodiment includes a water bottle main body 110 in which a liquid or different kinds of water container 20, 30 (FIG. 1) are received, and a cap 120 coupled to an upper part of the water bottle main body 110 to discharge the liquid out of the water bottle main body 110.

The water bottle main body 110 is formed in a cylindrical shape and has an open upper part, and accommodates liquids or different kinds of water containers 20, 30 therein. The water bottle main body 110 may accommodate liquid such as water or beverage. A user may fill the inside of the water bottle main body 110 with the desired beverage or water and carry it around.

Figure 4:
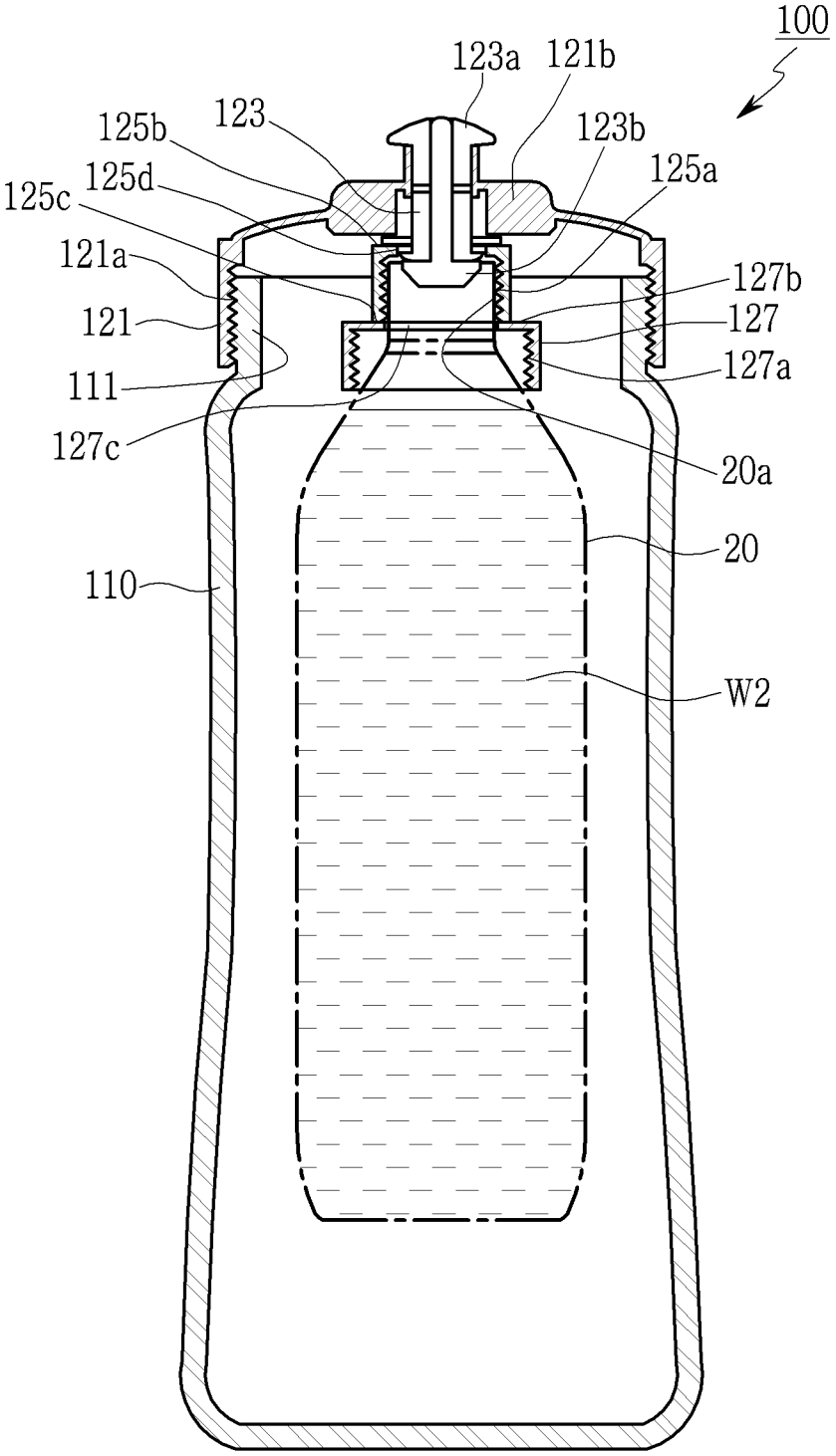
FIG. 4 is an exemplary cross-sectional view showing a state in which a first kind of water container is received in a multi-function water bottle according to an exemplary embodiment.
Figure 5:
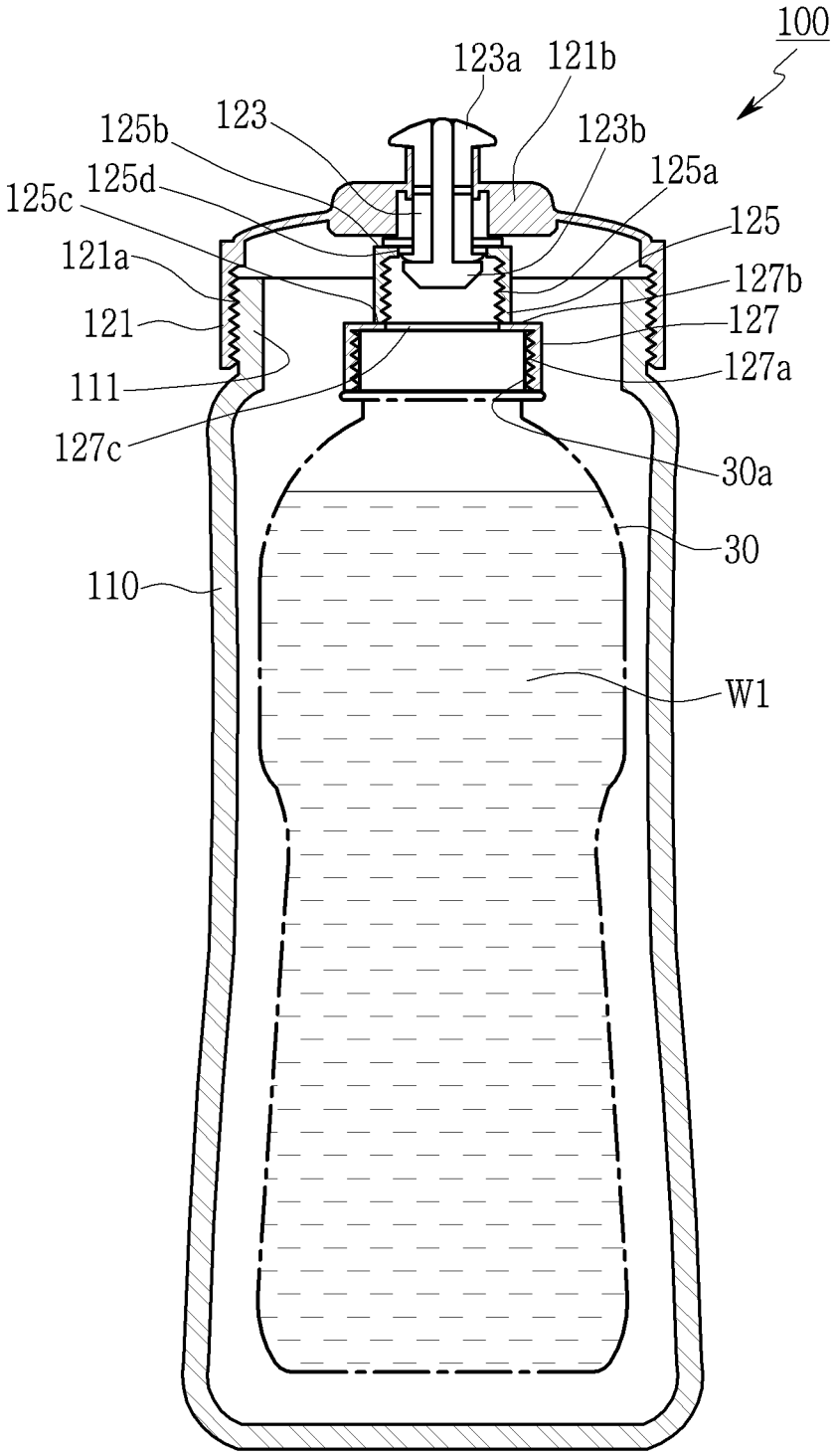
FIG. 5 is a cross-sectional view showing a state in which a second kind of water container is received in the multi-function water bottle according to an exemplary embodiment.

As shown in FIGS. 4 and 5, the first kind of water container 20 or the second kind of water container 30 may be received in the water bottle main body 110 and used therein. In this example, the first kind of water container 20 may be a water bottle or a kind of bottle that has a first outlet 20*a* in the same size as that of the water bottle. The first kind of water container 20 has a first kind of cap 21 that is 30 mm in diameter with reference to a 500 ml-capacity bottled water container. Instead of the bottled water container, the first kind of water container 20 may be a coke bottle, a cider bottle, a juice bottle, and so on that uses the first kind of cap 21 of the same diameter.

The second kind of water container 30 may be a sports drink bottle or a kind of bottle that has a second outlet 30*a* in the same size as that of the sports drink bottle. The second kind of water container 30 may be a 600 ml-capacity Powerade bottle. In this example, the diameter of the second kind of cap 31 is formed greater than 30 mm, i.e., greater than the diameter of the first kind of cap 21.

The water bottle main body 110 is sized to accommodate the first kind of water container 20 and the second kind of water container 30. To this end, the opening formed in the upper part of the water bottle main body 110 is formed in a greater diameter (r) than the diameter of the first and second kind of water containers 20, 30. The water bottle main body 110 is formed with an almost constant diameter from the lower to upper parts such that the first kind of water container 20 and the second kind of water container 30 can be easily received therein.

In addition, the height (h) of the water bottle main body 110 is formed higher than the height of the first kind of water container 20 and the second kind of water container 30 by a certain height.

A cap coupling tube 111 to be coupled to the cap 120 is formed with a certain length in the upper part of the water bottle main body 110. Since the cap coupling tube 111 is inserted into the inner wall surface of the main body coupling tube 121 of the cap 120, the cap couplingtube is stepped by a predetermined thickness relative to the water bottle main body 110. A first screw thread 113 is formed on the outer wall surface of the cap coupling tube 111. The first screw thread 113 is screw-coupled to a second screw thread 121*a* formed on the inner wall surface of the main body coupling tube 121 of the cap 120.

In this example, when the user is in a sporting activity such as a cycling, the user may not be able to hold the water bottle main body 110 on hand himself/herself, and considering this, the water bottle main body 110 may have a size corresponding to the size of a holder (not shown) for fixing the water bottle main body 110.

The cap 120 is coupled compatibly to the first kind of water container 20 and the second kind of water container 30 as well as to the water bottle main body 110, to allow the liquid contained in the water bottle main body 110, first auxiliary liquid contained in the first kind of water container 20 and second auxiliary liquid contained in the second kind of water container 30 to be discharged.

As shown FIGS. 3 and 4, the cap 120 includes a main body coupling tube 121 screw-coupled to the upper cap coupling tube 111 of the water bottle main body 110, a discharge tube coupling surface 121*b* disposed horizontally on the upper part of the main body coupling tube 121, and a liquid discharge tube 123 formed perpendicularly to the discharge tube coupling surface 121*b* to discharge the liquid contained therein to outside.

Further, the cap 120 includes an inner coupling tube 125 and an intermediate coupling tube 127 which are concentrically formed within the main body coupling tube 121. The inner coupling tube 125 is screw-coupled to the first outlet 20*a* of the first kind of water container 20 and the intermediate coupling tube 127 is screw-coupled to the second outlet 30*a* of the second kind of water container 30.

In this example, the inner coupling tube 125 is formed to correspond to the size and shape of the first cap 21 of the first kind of water container 20 shown in FIG. 1, and the intermediate coupling tube 127 is formed to correspond to the size and shape of the second cap 31 of the second kind of water container 30 shown in FIG. 1.

A second screw thread 121*a* for screw-coupling with the first screw thread 113 of the cap coupling tube 111 is formed on the inner wall surface of the main body coupling tube 121. The first screw thread 113 and the second screw thread 121*a* may be female threads or male threads.

The discharge tube coupling surface 121*b* is formed horizontally by a certain area on the upper part of the main body coupling tube 121. A liquid discharge tube 123 is formed in the center region of the discharge tube coupling surface 121*b*. The liquid discharge tube 123 is passed through the discharge tube coupling surface 121*b* and extended vertically by a certain length. A lower end 123*b* of the liquid discharge tube 123 extends into the inner coupling tube 125.

An upper end 123*a* of the liquid discharge tube 123 has a cruciform slit or an openable cap such that, when the user sucks the liquid through the mouth, the liquid is discharged by the suction pressure to be flowed out through the liquid discharge tube 123 through the lower end 123*b*.

The inner coupling tube 125 is fixed to the lower surface of the discharge tube coupling surface 121*b* of the main body coupling tube 121. The inner coupling tube 125 is formed in the shape of a cylindrical tube and has a third screw thread 125*a* formed on the inner wall surface to be coupled to a fourth thread (not shown) formed in the first outlet 20*a* of the first kind of water container 20. A main body coupling surface 125*b* is formed by a certain area on the upper surface of the inner coupling tube 125, through which an upper outlet 125*d* is extended for guiding liquid to the liquid discharge tube 123. The main body coupling surface 125*b* is fixed to the lower surface of the discharge tube coupling surface 121*b* by a method such as heat fusion or ultrasonic fusion.

The lower coupling end 125*c* of the lower part of the inner coupling tube 125 is fixed to the coupling tube coupling surface 127*b* of the intermediate coupling tube 127. Thus, the inner coupling tube 125 and the intermediate coupling tube 127 are arranged vertically to thus form a stepped portion. Accordingly, when the second kind of water container 30 is coupled to the intermediate coupling tube 127, the inner coupling tube 125 is not interfered.

The intermediate coupling tube 127 is disposed between the inner coupling tube 125 and the main body coupling tube 121. Since the intermediate coupling tube 127 is coupled to the lower part of the inner coupling tube 125, the intermediate coupling tube 127 is exposed to the lower part of the main body coupling tube 121 as shown in FIG. 3.

A fifth screw thread 127*a* for screw-coupling with a sixth thread (not shown) formed on the second outlet 30*a* of the second kind of water container 30 is formed on the inner wall surface of the intermediate coupling tube 127. A coupling tube coupling surface 127*b* is formed on the upper part of the intermediate coupling tube 127 by a predetermined area, having a lower outlet 127*c* extending there through to guide the liquid to the liquid discharge tube 123.

The process of using the multi-function water bottle 100 according to an exemplary embodiment having the configuration described above will be described with reference to FIGS. 2 to 5.

The multi-function water bottle 100 according to an exemplary embodiment is provided to suit for a size of a holder (not shown) sports activity such as cycling.

The user may use one multi-function water bottle 100 in three ways as he or she desires. As shown in FIG. 2, the first way is to directly fill the water bottle main body 110 of the multi-function water bottle 100 with water or beverage and carry it around and drink it as need arises. The second way is that the first kind of water container 20 is received within the multi-function water bottle 100 and the user drinks the first auxiliary liquid W1 filled in the first kind of water container 20, as shown in FIG. 4. The third way is that the second kind of water container 20 is received within the multi-function water bottle 100 and the user drinks the second auxiliary liquid W1 filled in the second kind of water container 20.

The user may first drink the liquid filled within the water bottle main body 110 with the first method and when drinking up all the liquid, purchase the first kind of water container 20 or the second kind of water container 30, and then store the container 20 or 30 within the water bottle main body 110 and use it 20 or 30.

In this example, the first kind of water container 20 may be removed of the first cap 21 coupled therewith and instead coupled to the inner coupling tube 125 of the present disclosure and used. Likewise, the second kind of water container 30 may be removed of the second cap 31 coupled therewith, and instead coupled to the intermediate coupling tube 127 of the present disclosure and used.

Specifically, when coupling the first kind of water container 20 with the multi-function water bottle 100 of the present disclosure and using the same, the user may couple the cap 120 of the present disclosure with the upper part of the first kind of water container 20. To this end, the first outlet 20*a* of the first kind of water container 20 is screw-coupled to the third screw thread 125*a* of the inner coupling tube 125.

The first kind of water container 20 coupled to the cap 120 is received in the water bottle main body 110 and then the first screw thread 113 of the cap coupling tube 111 is coupled to the second screw thread 121*a* of the main body coupling tube 121 to seal the multi-function water bottle 100.

In this state, the user may fix the multi-function water bottle 100 to a holder (not shown) fixed to the cycle while he or she is enjoying the sporting activity. When feeling thirsty during the activity, the user may separate the multi-function water bottle 100 from the holder (not shown) and drink the first auxiliary liquid W1 by sucking the upper end 123*a* of the liquid discharge tube 123 through the mouth.

Accordingly, the first auxiliary liquid W1 is not mixed with the liquid possibly remaining within the water bottle main body 110 and user can taste the first auxiliary liquid W1 as is.

Meanwhile, when the user purchases the second kind of water container 30, the cap 120 of the present disclosure may be coupled to the upper part of the second kind of water container 30 as shown in FIG. 5. To this end, the second outlet 30*a* of the second kind of water container 30 is coupled to the fifth screw thread 127*a* of the intermediate coupling tube 127. Then, the second kind of water container 30 is received into the water bottle main body 110 and used therein.

As described above, the multi-function water bottle according to exemplary embodiments not only allows the user to drink the liquid contained in the water bottle main body, but also accommodates therein the first kind of water container or the second kind of water container containing different kinds of liquid and drinks the same.

Accordingly, one cap can be coupled to both the first kind of water container and the second kind of water container and thus, user convenience is provided. In addition, since the first kind of water container and the second kind of water container can be received and stored within the water bottle main body, mixing of the remaining liquid in the water bottle main body with the auxiliary liquid of the first kind of water container or the second kind of water container is prevented, and accordingly, hygienic storage can be provided.

Further, when performing a sporting activity such as cycling, the user may store the first kind of water container and the second kind of water container of different sizes within the multi-function water bottle that is customized for the holder, such that the user can focus on sporting activity stably while he or she enjoys various kinds of drinks.

As described above, the embodiments of the multi-function water bottle according to an exemplary embodiment are merely illustrative and those skilled in the art will appreciate that various modifications and equivalent embodiments are possible without departing from the scope of the present invention. Therefore, it is to be understood that the disclosure is not limited to the specific embodiments shown and described herein. Accordingly, the true scope of the present disclosure should be determined by the technical idea of the appended claims. It is also to be understood that the disclosure includes all modifications, equivalents, and alternatives falling within the spirit and scope of the disclosure as defined by the appended claims.

For example, the water bottle according to the present disclosure may be configured such that only a first kind of water container having a relatively smaller mouth (e.g., beverage bottle, bottled water bottle, or the like, which have a smaller mouth) can be received therein or removed therefrom, or alternatively, the water bottle may be configured such that only a second kind of water container having a relatively larger mouth (e.g., other beverage bottles with larger mouth, such as, Gatorade bottle, and so on) can be received therein or removed therefrom

INDUSTRIAL APPLICABILITY

The present disclosure relates to a multi-function water bottle and can be advantageously applicable in the field of sports container manufacturing and distribution industry.

The invention claimed is:

1. A multi-function water bottle comprising:

a water bottle main body comprising a receiving space for receiving a liquid formed therein;

a cap coupled with an upper portion of the water bottle main body to discharge the liquid, wherein the cap comprises:

a main body coupling tube coupled with a cap coupling tube on the upper portion of the water bottle main body;

a liquid discharge tube provided at an upper portion of the main body coupling tube to discharge the liquid; and an inner coupling tube provided within the main body coupling tube and coupled with a first outlet of a first type water container received in the receiving space of the water bottle main body to guide a first auxiliary liquid received in the first type water container to the liquid discharge tube; and an intermediate coupling tube provided between the inner coupling tube and the main body coupling tube and coupled with a second outlet of a second kind of water bottle to guide a second auxiliary liquid received in the second type water container to the liquid discharge tube.

2. The multi-function water bottle of claim 1, wherein the first type water container is any of a bottled water container, a carbonated drink bottle, and a fruit juice bottle having a first diameter, wherein the second type water container is any of a bottled water container, a sports drink bottle and a fruit juice drink bottle, having a second outlet with a diameter greater than that of the first outlet of the first type water container.

3. The multi-function water bottle of claim 2, wherein the inner coupling tube comprises:

a third screw thread formed along an inner wall surface and screw-coupled with the first outlet of the first type water container;

a main body coupling surface formed horizontally by a predetermined area on an upper surface and fixedly coupled with a lower surface of the cap coupling tube; and an upper outlet extending through the main body coupling surface to guide the first auxiliary liquid to the liquid discharge tube, wherein the intermediate coupling tube comprises:

a coupling tube coupling surface, to which a lower end of the inner coupling tube is fixed, and through which a lower outlet formed communicatively with the upper outlet is extended; and a fifth screw thread formed along an inner wall surface and screw-coupled with the second outlet of the second type water container.

* * * * *